US008613697B2

(12) United States Patent
Otte et al.

(10) Patent No.: US 8,613,697 B2
(45) Date of Patent: Dec. 24, 2013

(54) INCUBATOR WITH DIFFERENT OPERATING STATES

(75) Inventors: Tobias Otte, Lübeck (DE); Jochim Koch, Ratzeburg (DE); Arthur Chung-Che Kuo, Lübeck (DE)

(73) Assignee: Dräger Medical GmbH, Lübeck (DE)

( * ) Notice: Subject to any disclaimer, the term of this patent is extended or adjusted under 35 U.S.C. 154(b) by 1680 days.

(21) Appl. No.: 11/926,247

(22) Filed: Oct. 29, 2007

(65) Prior Publication Data

US 2008/0125619 A1 May 29, 2008

(30) Foreign Application Priority Data

Nov. 28, 2006 (DE) ..... 10 2006 056 039

(51) Int. Cl.
*A61G 11/00* (2006.01)

(52) U.S. Cl.
USPC ..... 600/22

(58) Field of Classification Search
USPC ..... 600/21, 22; 128/846; 237/3; 454/188–190
See application file for complete search history.

(56) References Cited

FOREIGN PATENT DOCUMENTS

| | | | |
|---|---|---|---|
| DE | 103 20 195 | B4 | 12/2004 |
| DE | 102004016080 | A1 | 8/2005 |
| DE | 69 635 498 | T2 | 8/2006 |
| DE | 102006044671 | A | 4/2008 |

*Primary Examiner* — Christine Matthews
(74) *Attorney, Agent, or Firm* — McGlew and Tuttle, P.C.

(57) ABSTRACT

An incubator or thermotherapy device is provided with a reclining surface and with one or more limiting walls and with openings or removed side walls and with a foot side opening or removed foot-side side wall. Air discharge channels (7, 8, 9), on sides, contain guide elements of a guide device (11) with angles in the range of about 15° to 100° and spoilers of a deflecting device (13) with deflection angles of about 15° to 110°. The air discharge velocity is in the range of about 0.1 m/sec to 1.0 m/sec. The guide elements discharge angle in the front-side discharge channel corresponds to the deflection angle of the spoilers in the discharge channels. The air discharge velocity from the front-side discharge channel has a maximum in the middle of the discharge channel and changes continuously towards the sides to the air discharge velocity from the discharge channels.

11 Claims, 8 Drawing Sheets

INCUBATOR WITH DIFFERENT OPERATING STATES

CROSS REFERENCE TO RELATED APPLICATIONS

This application claims the benefit of priority under 35 U.S.C. §119 of German Patent Application DE 10 2006 056 039.6 filed Nov. 28, 2006, the entire contents of which are incorporated herein by reference.

FIELD OF THE INVENTION

The present invention pertains to an incubator with different operating states and with a corresponding configuration with different numbers of different, removable limiting walls, wherein at least one vertical head-side limiting wall is present in the minimal configuration.

BACKGROUND OF THE INVENTION

Contrary to closed incubators, thermotherapy devices that are completely open above the reclining surface for premature and newborn patients offer a substantially better access for care and therapy measures at the patient. Open thermotherapy devices are also called open patient care units. However, temperature stabilization and air conditioning suitable for the patient continues to be a technical challenge in such thermotherapy devices. According to DE 103 20 195 B4 or DE 10 2004 016 080 A1, the microclimate above the reclining surface of an open thermotherapy device is embodied by air flows from discharge channels along the sides of the reclining surface. To minimize the energy consumption, the air flows are returned or recycled especially through an exhaust unit arranged fittingly on the head side above the reclining surface.

Regardless of whether single-layer or two-layer air flows are used on the particular sides of the reclining surface, the discharges are directed at a constant angle to the reclining surface and/or at a constant angle to the head-side exhaust unit. Moreover, the velocity distributions of the air flows along the respective discharge channels remain constant. Due to the constant angles and constant velocities over the course of the sides of the reclining surface, shears develop between the individual air flows, which lead to swirling and consequently to an extensive instability of the microclimate. In addition, the constant velocity in terms of direction and value leads to a predetermined discharge directed towards the exhaust unit.

On the other hand, incubators completely closed by limiting walls offer the great advantage of a stable and readily controllable climate in the interior space, so that the premature or newborn patients enjoy an especially adequate, physiologically desired accommodation and air conditioning.

SUMMARY OF THE INVENTION

The object of the present invention is to provide an improved incubator or a thermotherapy device with the particular configuration, corresponding to a different number of limiting walls present, adapted design such that the microclimate is stable for a long time above the reclining surface in all configurations and reduced energy consumption is necessary.

The orientation of the air flows is achieved by changing the discharge angles along the sides around the reclining surface. In addition, adaptation of the velocity values for all sides along the discharge channels ensures a low-shear meeting of the discharges.

An exemplary embodiment will be explained below on the basis of the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 1:
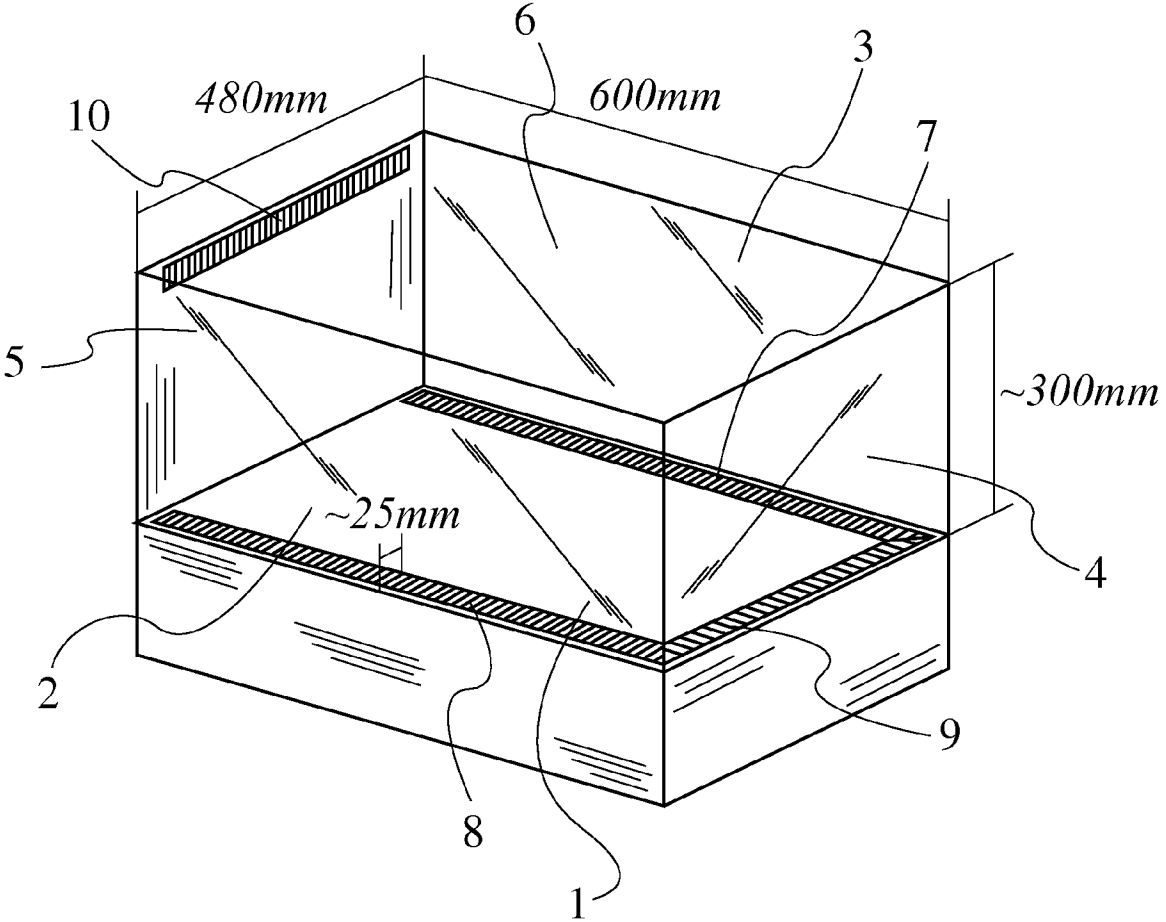
FIG. 1 is a schematic perspective view of an incubator or a thermotherapy device for explaining the relevant components according to the invention.

Referring to the drawings in particular the incubator or the thermotherapy device according to FIG. 1 has discharge channels 7, 8, 9, which extend on the sides of the reclining surface 1 in the longitudinal direction in parallel and in the foot area at right angles to the longitudinal direction, and whose direction and size can be set in respect to the air conditioned in terms of temperature and humidity. The discharge channels 7, 8, 9 have a width of 25 mm in the exemplary embodiments.

The reclining surface 1 is limited by a fixed side wall 5 and by limiting walls 2, 3, 4, 6, which can be positioned variably and removed, and which make access to the patient possible to different extents as needed, namely, through two long-side side walls 2, 3, a front-side or foot-side side wall 4 and an upper limiting wall 6, which extends essentially in parallel to the reclining surface 1 and which forms the hood cover when the incubator is closed on all sides. The distance between the limiting wall 6 and the reclining surface 1 is approximately 300 mm. The distance between the two side walls 2, 3 is approximately 480 mm, and the distance between the two head- and foot-side side walls 5, 4 is approximately 600 mm.

The head-side side wall 5 is present in all embodiments and has the exhaust unit 10 arranged in the upper side area below the upper limiting wall 6. This exhaust unit 10 has a flow area of, e.g., 30×300 mm.

The air, drawn off by the exhaust unit 10 with a fan, not shown, and mixed with ambient air, is recirculated and returned into the incubator or the thermotherapy device via the discharge channels 7, 8, 9. The output of the forced air circulation thus changes depending on the setting of the air velocity in the different configurations of the incubator or the thermotherapy device.

Figure 2:
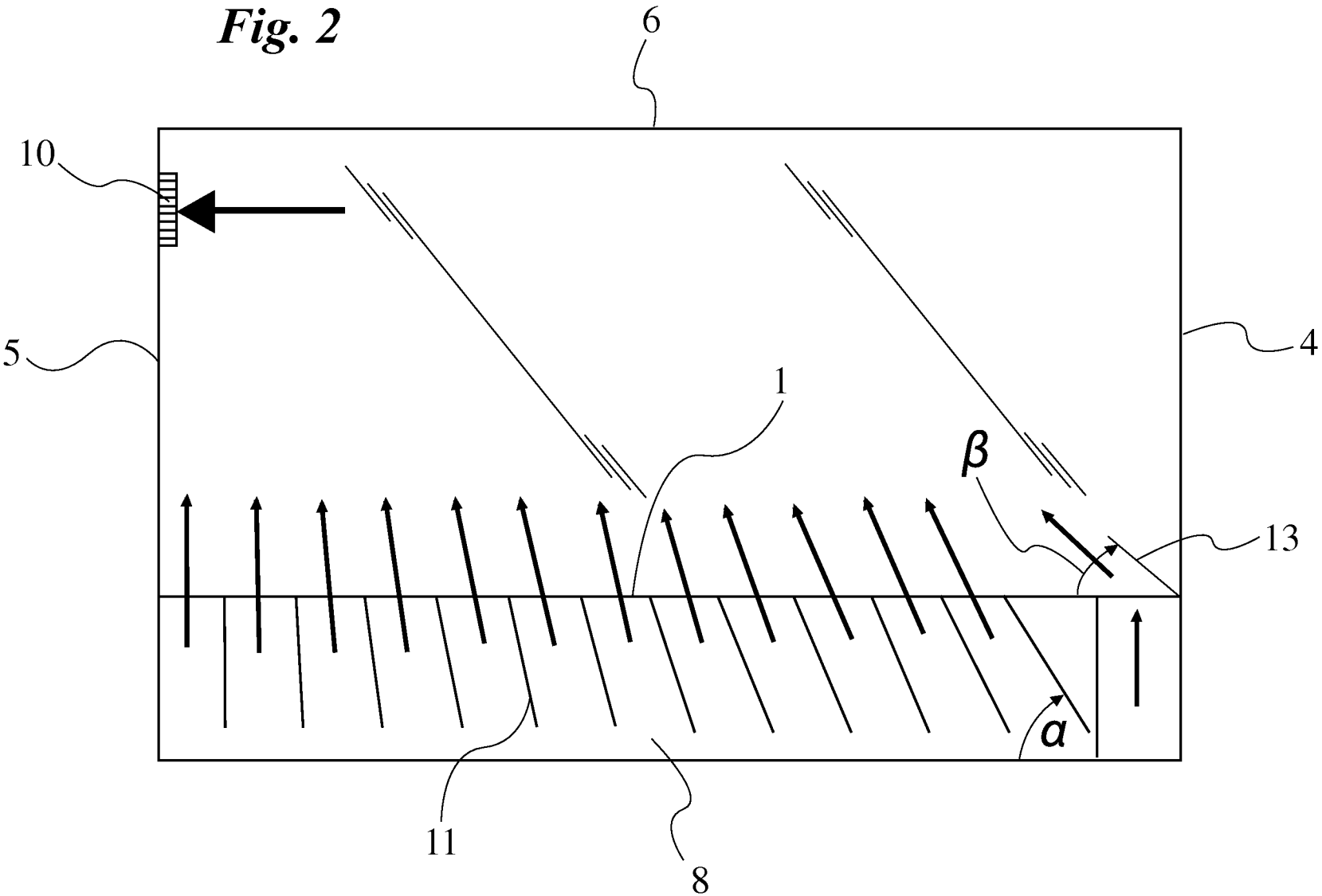
FIG. 2 is a schematic longitudinal sectional view through the incubator according to FIG. 1 along a discharge channel extending in the longitudinal direction of the reclining surface.
Figure 3:
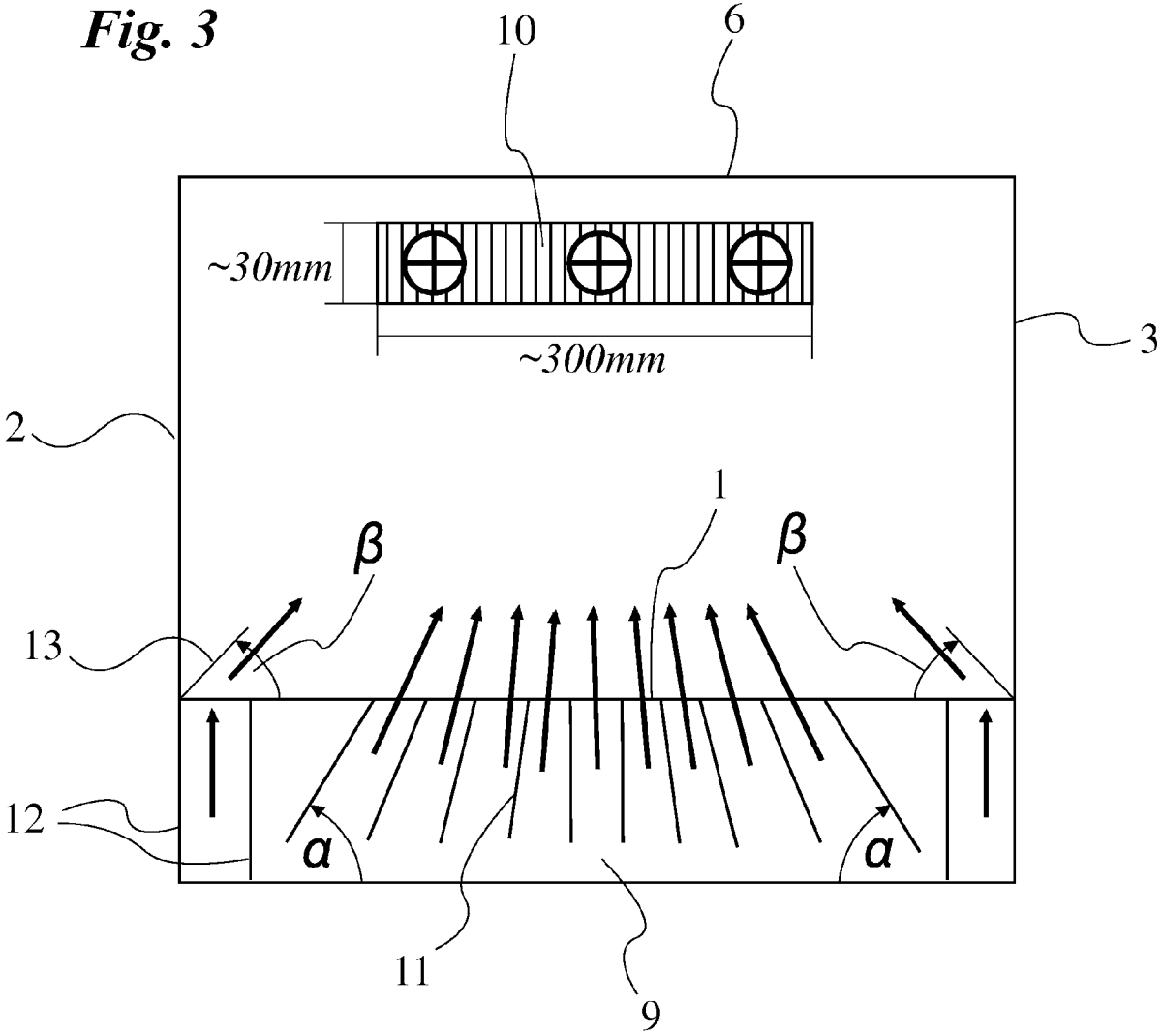
FIG. 3 is a schematic vertical sectional view through the flow-side discharge channel at right angles to the longitudinal direction of the reclining surface.

The discharge channels 7, 8, 9 have mechanical or electric motor-actuated setting means for setting a velocity distribution in relation to the value of the velocity as well as electric motor-actuated setting means for deflecting or setting the direction of the air being discharged, which are schematically shown in FIGS. 2 and 3. Reference is therefore made expressly to the patent application DE 10 2006 044 671.2 (and application Ser. No. 11/856,268 filed Sep. 17, 2007, which is hereby incorporated by reference in its entirety). The electric motor-actuated setting means are preferably actuated via a central analysis and control unit, which receives, for example, corresponding signals from sensors, which detect the presence or the optional absence of one or more of the limiting walls 2, 3, 4, 6.

As an alternative, corresponding settings may also be performed manually by a human operator or medical care staff on the central analysis and control unit.

The guide elements of the guide means 11, which the guide elements act as setting means for the air being discharged, are arranged in the lateral discharge channels 7, 8 extending along the longitudinal direction of the reclining surface 1 between the channel walls 12 (FIG. 3) and are mounted such that they can be set, when needed, corresponding to a certain angle α, measured from the horizontal. The setting by means of the guide elements of the guide means 11 increases especially over the long sides of the reclining surface 1 up to the head side of the reclining surface 1, which is close to the exhaust, so that the air is discharged vertically there.

The guide elements 11 are arranged vertically in the middle in the area of the foot-side side wall 4, (FIG. 3). The guide elements 11 are designed here as well such that they can be deflected by the angle α when needed. The angle α preferably decreases here towards the corners of the foot side.

The additional deflection of the air being discharged, characterized by the angle β with the reclining surface 1, likewise measured from the horizontal, is embodied by deflecting elements of a deflecting means 13 in the area of the air flow outlet. These deflecting elements may be designed as shown in the exemplary embodiment (FIGS. 2 and 3). They are called "spoilers" below. The spoilers of the deflecting means 13 are designed especially such that the angle β with the reclining surface 1 changes continuously over the respective courses of the discharge channels 7, 8 along the reclining surface 1. In the simplest case, the angle β is constant at least over the length of one side.

The corresponding settings of the setting means in the discharge channels 7, 8, 9 and the values of the discharge velocities will be stated below for the different configurations corresponding to FIGS. 4 through 7. The spoiler 13 has especially a flat geometry here and is made especially in one piece for each longitudinal side and the foot side, so that the angle β does not change over the course of the respective side.

Figure 4:
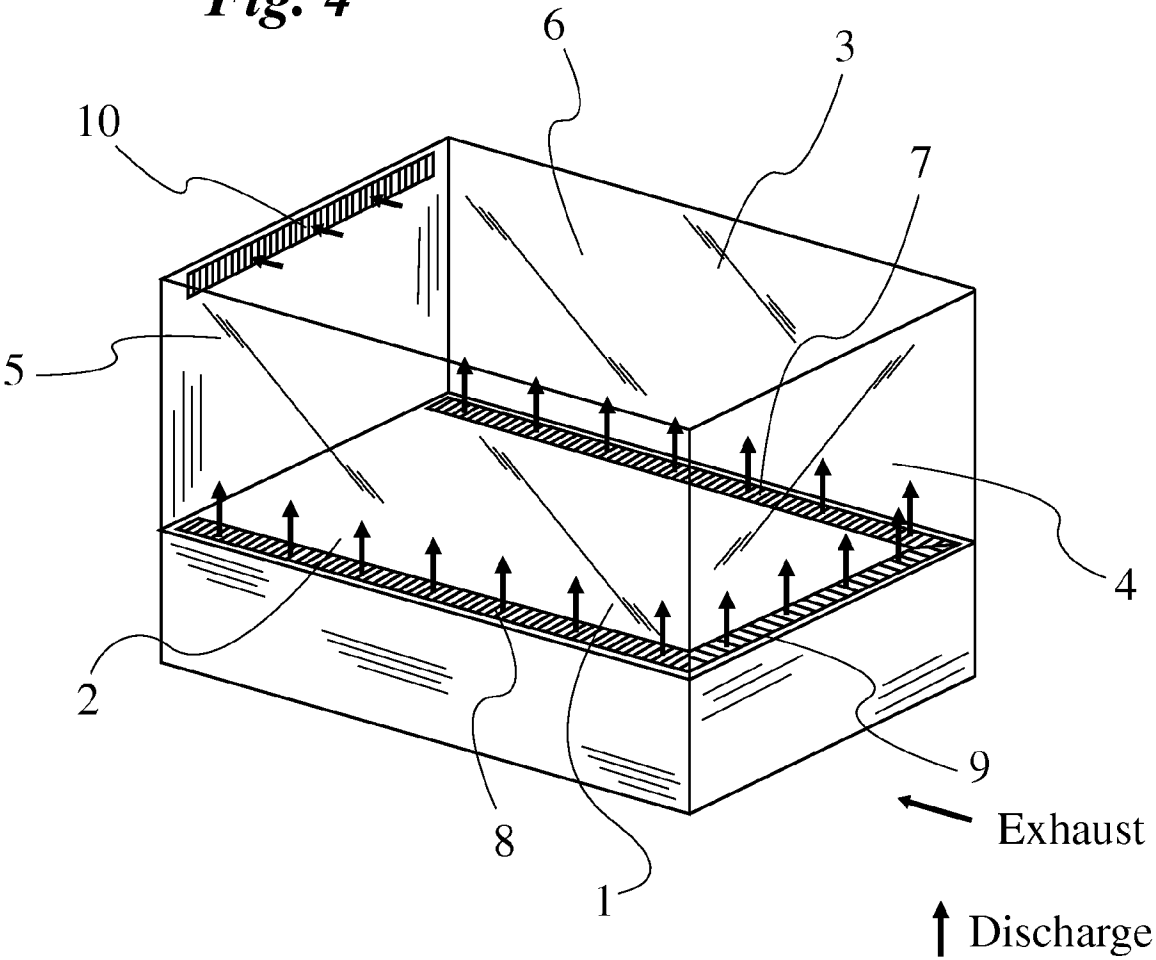
FIG. 4 is a perspective schematic view of an incubator according to the invention shown with limiting walls closed on all sides around the reclining surface as well as with a corresponding flow distribution from the discharge channels around the reclining surface and exhaust through the exhaust unit in the head area above the reclining surface.

According to FIG. 4, the incubator is closed from the environment on all sides by its limiting walls 2, 3, 4, 5, 6. The guide elements 11 in the discharge channels 7, 8, 9 are arranged in parallel in this case, α=90°, and the spoilers 13 form the extensions of the outer discharge channels 7, 8, 9 in this case, i.e., β=90°. The air flows are thus discharged at right angles to the reclining surface 1. The values of the discharge velocities at the two long-side side walls 2, 3 and in the area of the foot-side side wall 4 are constant over the courses between 0.05 m/sec and 0.1 m/sec. As a result, a volume flow range of up to 5 $m^3$/hr. to 15 $m^3$/hr. is obtained for the forced air circulation via the exhaust unit 10.

Figure 5:
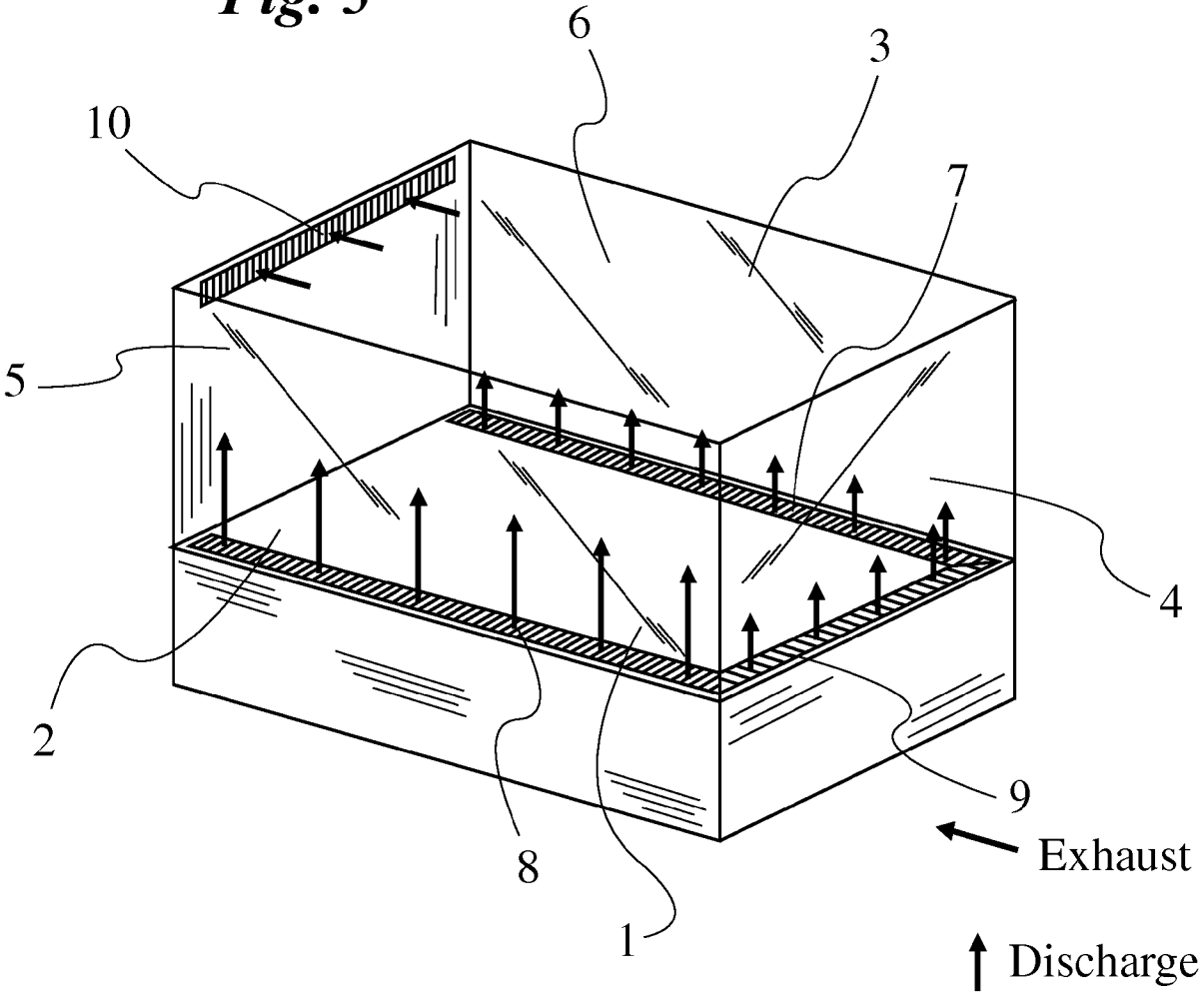
FIG. 5 is a perspective schematic view of an incubator according to the invention with a side wall removed on the front longitudinal side along the reclining surface as well as with a corresponding flow distribution from the discharge channel around the reclining surface and exhaust through the exhaust unit in the head area above the reclining surface.

If a long-side side wall 2 or 3, corresponding to FIG. 5 especially the front long-side side wall 2, is now lowered, pivoted away or removed, the guide elements 11 and the spoilers 13 are set as follows:

a) The guide elements 11 are set at an angle α between 90° and 75° in the area of the opened side wall 2. The spoilers 13 form the extension of the outer channel wall with β=90° or are deflected in both directions by a maximum of 15°. The value of the discharge velocity is constant at more than 0.1 nm/sec over the course.

b) The guide elements 11 are set vertically, α=90°, in the area of the closed side wall 3. The spoilers 13 form the extension of the outer channel wall with β=90°. The value of the discharge velocity is constantly low at less than 0.1 m/sec over the course.

c) The guide elements 11 are set vertically, α=90°, or they correspond to the angle β of the side walls 2, 3 in the area of the foot-side side wall 4. The angle β of the spoilers 13 corresponds to the smallest angle α of the side walls 2, 3.

The value of the discharge velocity is constantly low at less than 0.1 m/sec over the course. A volume flow range of up to 5 $m^3$/hr. to 40 $m^3$/hr. is obtained for the forced air circulation via the exhaust unit 10 for this configuration.

Figure 6:
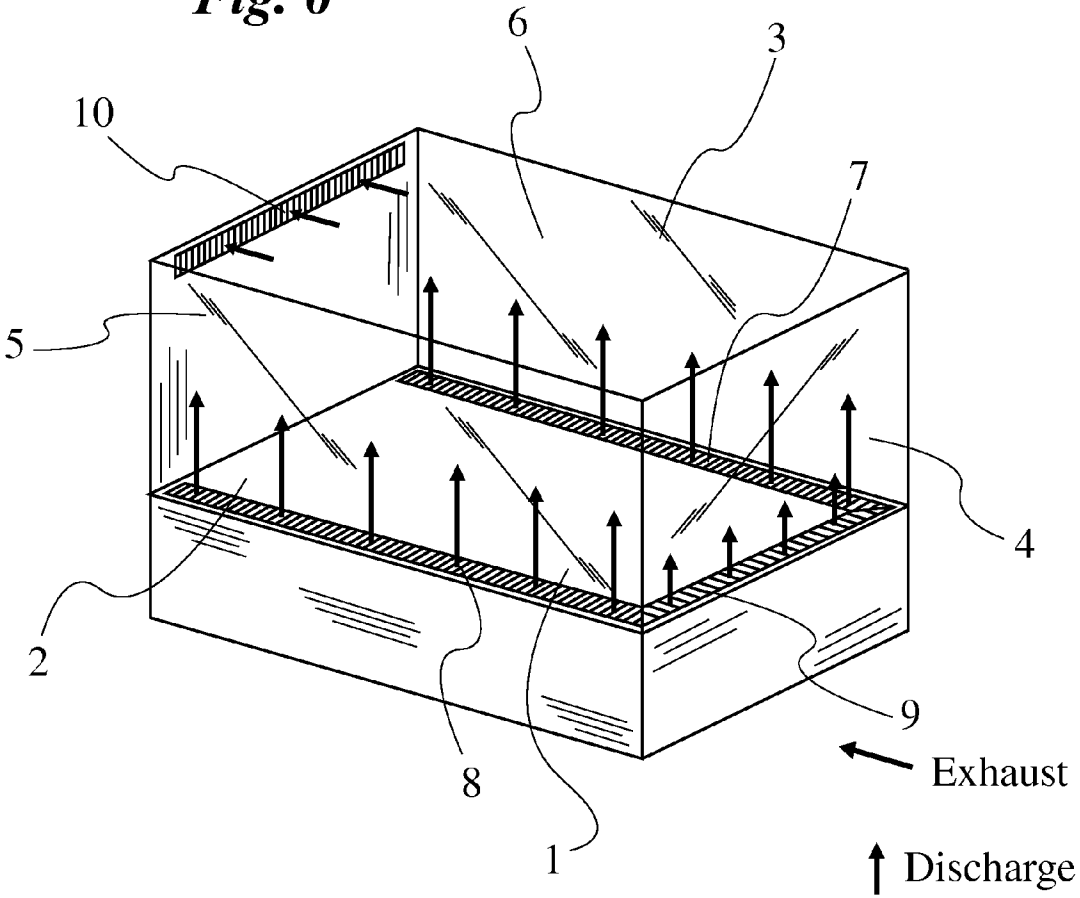
FIG. 6 is a perspective schematic view of an incubator according to the invention with side walls removed on both longitudinal sides along the reclining surface as well as with a corresponding flow distribution from the discharge channels and exhaust through the exhaust unit in the head area above the reclining surface.

If both long-side side walls 2 and 3 are opened or removed, lowered or pivoted away according to FIG. 6, the following settings are performed:

a) The guide elements 11 in the lateral discharge channels 7, 8 of the opened long sides are set at an angle α between 75° and 90°. The spoilers 13 form the extension of the outer channel wall with β=90° or are deflected in both directions by up to 15°. The value of the discharge velocity is constant in the range of >0.1 nm/sec over the course.

The settings are identical on the two opened long sides.

b) In the area of the closed foot-side side wall 4, the guide elements 11 are set vertically, α=90°, or the angle α of the guide elements 11 corresponds to angle β of the long sides. Angle β of the spoilers 13 corresponds to the smallest angle α of the long sides.

The discharge velocity is constant over the course with less than 0.1 n/sec. A volume flow range of up to 12 $m^3$/hr. to 70 $m^3$/hr. is obtained for the forced air circulation via the exhaust unit 10 for this configuration.

Figure 7:
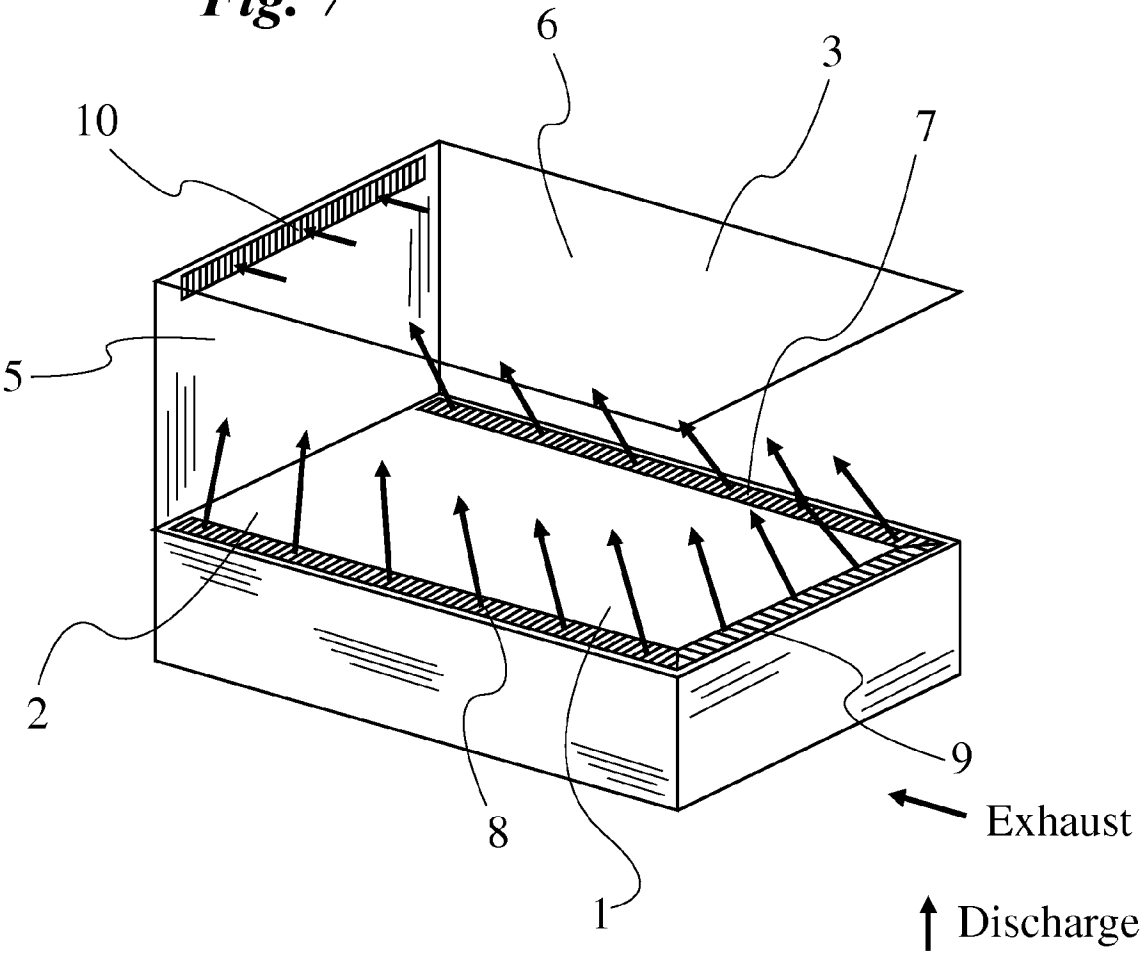
FIG. 7 is a perspective schematic view of an incubator according to the invention with a side wall present on the head side only and with the upper limiting wall present above and in parallel to the reclining surface as well as with a corresponding flow distribution from the discharge channels and exhaust through the exhaust unit in the head area above the reclining surface.

The following settings are active if both long-side side walls 2 and 3 and the foot-side side wall 4 are opened according to FIG. 7, the following settings are active:

a) The guide elements 11 in the lateral discharge channels 7, 8 of the two opened long sides are set at an angle α between 50° and 110°. The spoilers 13 of the long sides are set at an angle β between 60° and 110°. The value of the discharge velocity has a continuous distribution over the courses. It increases continuously with the distance of the discharge from the exhaust unit 10 from 0.2 m/sec to above 0.4 m/sec.

b) The angles α of the guide elements 11 correspond to the angle β of the long sides in the area of the opened foot-side side wall 4, i.e., they are between 60° and 90°.

(The angle β of the spoilers 13 on the foot side may correspond to the smallest angle α of the long sides.)

The discharge velocity has a maximum of about 0.5 m/sec over the course of the foot side in the middle. The discharge velocity changes continuously towards the long sides until it has the same value as the long sides at the corners.

Figure 8:
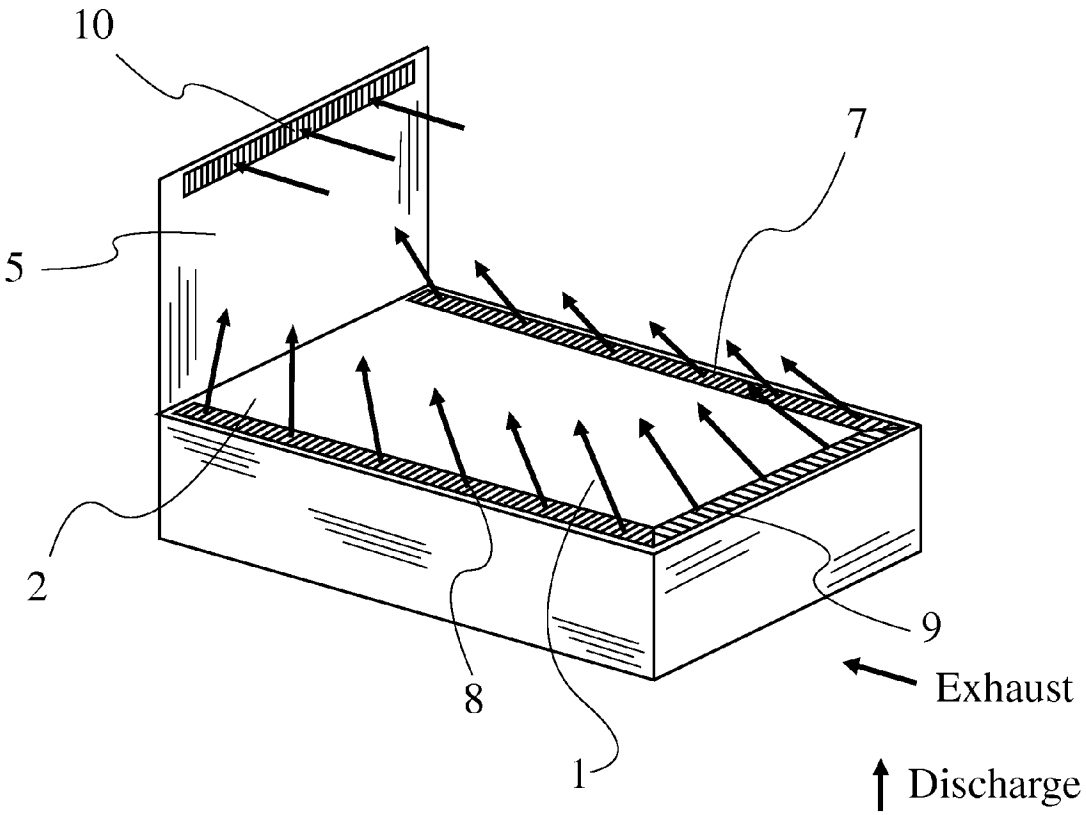
FIG. 8 is a perspective schematic view of an incubator according to the invention in the minimal configuration with the side wall present on the head side only as well as with a corresponding flow distribution from the discharge channels and exhaust through the exhaust unit in the head area above the reclining surface.

The following conditions occur if all walls except the head-side side wall 5 with the exhaust unit 10 are removed according to FIG. 8:

a) The guide elements 11 in the lateral discharge channels 7, 8 have a continuous angle setting α of 90° in the vicinity of the exhaust unit 10 and between 15° and 90° in the area of the foot side, i.e., at the maximum distance from the exhaust unit 10.

The angle β of the spoilers 13 of the long sides are set between 15° and 100°.

The discharge velocity has a continuous distribution over the courses of the long sides. It increases continuously from 0.2 m/sec to 1 m/sec with the distance of the site of discharge from the exhaust unit 10.

b) On the foot side, the smallest angle α of the guide elements 11 equals the angle β of the long sides. (The angle β of the spoiler 13 on the foot side corresponds to the smallest angle α of the long sides.)

The discharge velocity has a maximum of up to 1 m/sec in the middle over the course of the foot side. The discharge velocity changes continuously towards the long sides until it has the same value as on the long sides in the two corners.

The embodiments described represent the geometric conditions for the special examples, without the actual position of the patient on the reclining surface 1 being specified by the designations "head side," "head-side" or "foot side" or "foot-side."

The designation "foot side" corresponds here, according to the figures, to the designation "front side."

While a specific embodiment of the invention has been shown and described in detail to illustrate the application of the principles of the invention, it will be understood that the invention may be embodied otherwise without departing from such principles.

What is claimed is:

1. An incubator or thermotherapy device comprising:

a reclining surface;

limiting walls above said reclining surface and including an upper limiting wall;

discharge channels for air, said discharge channels being provided along each of two long sides of said reclining surface and along a front side of said reclining surface;

a guide means with guide elements set in said discharge channels at discharge angles, said guide elements being set in parallel to one another with said discharge angles in relation to said reclining surface of 90°+/−15° for said guide elements disposed adjacent to one of said limiting walls;

deflecting means with spoilers set at deflection angles in relation to said reclining surface of 90°+/−15°, said spoilers being located along each of said two long sides of said reclining surface and on said front side of said reclining surface; and an exhaust unit located opposite the front side and positioned under said upper limiting wall for exhausting air, said discharge channels having an air discharge velocity from said discharge channels from 0.05 m/sec to 1.0 m/sec.

2. An incubator or thermotherapy device according to claim 1, wherein:

said limiting walls above said reclining surface include a closed long side side wall opposite a long side side opening;

said guide elements comprise long-side side wall opening guide elements, said long side side wall opening guide elements being adjacent to said long side side wall opening with said discharge angles in the range of about 75° to 95 °;

said spoilers comprise a long side side wall opening spoiler, said long side side wall opening spoiler being adjacent to said long side side wall opening and being set at a deflection angle in the range of about 75° to 105°;

one of said discharge channels along long sides of said reclining surface is adjacent to said long side side wall opening and has an air discharge velocity higher than 0.1 m/sec;

said guide elements further comprise closed long side side wall guide elements, said closed long side side wall guide elements being adjacent to said closed long side side wall with said discharge angles of 90°+/−15°;

said spoilers further comprise a closed long side side wall spoiler, said closed long side side wall spoiler being adjacent to said closed long side side wall, set at an angle of 90°+/−10°;

an air discharge velocity from the discharge channel adjacent to said closed long side side wall is less than 0.3 m/sec;

said guide elements further comprise front side guide elements, said front side guide elements being adjacent to the front side with said discharge angles set to correspond to said deflection angles of said spoilers adjacent to said two long sides; and the air discharge velocity from said discharge channel on the front side is less than 0.3 m/sec.

3. An incubator or thermotherapy device according to claim 1, wherein:

said limiting walls above said reclining surface are not provided at said two long sides to provide long side side openings;

said guide elements comprise long side side opening guide elements, said long side side opening guide elements being adjacent to one of said long side side openings with said discharge angles in the range of about 75° to 95°;

said spoilers comprise long side side opening spoilers, said long side side opening spoilers being adjacent to said long side side openings, with said deflection angles between 75° and 105°;

said discharge channels comprise discharge channels respectively adjacent to said long side side openings with the air discharge velocity higher than 0.1 m/sec;

said guide elements further comprise front side guide elements, said front side guide elements being adjacent to said front side with said discharge angles corresponding to the deflection angles of said spoilers adjacent to said long side side openings; and the air discharge velocity of one of said discharge channels adjacent to the front side is lower than 0.3 m/sec.

4. An incubator or thermotherapy device comprising:

a reclining surface;

limiting walls above said reclining surface including an upper limiting wall with long side side wall openings and with a front side side opening;

discharge channels for air, said discharge channels comprising long side discharge channels provided along long sides of said reclining surface, and a front side discharge channel along a front side of said reclining surface;

a guide means with guide elements set in said discharge channels at discharge angles, said guide elements being set in parallel to one another;

deflecting means with spoilers set at deflection angles in relation to said reclining surface, said spoilers being located on both sides along said reclining surface and on said front side of said reclining surface; and an exhaust unit located opposite the front side and positioned under said upper limiting wall for exhausting air, wherein:

said guide elements comprise long side guide elements, said long side guide elements being adjacent to said long side side wall openings with discharge angles in the range of about 50° to 110°;

said spoilers comprise long side spoilers, said long side spoilers being respectively adjacent to said long side side openings with deflection angles in the range of about 60° to 110°;

the air discharge velocity from said long side discharge channels is in the range of about 0.2 m/sec to 0.5 m/sec;

guide elements in said front side discharge channel are set such that said discharge angles correspond to the deflection angles of said long side adjacent spoilers; and the air discharge velocity from said front side discharge channel has a maximum of 0.2 m/sec to 0.5 m/sec in a middle of said front side discharge channel and changes continuously towards the long side discharge channels until the air discharge velocity from said front side discharge channel reaches the same air discharge velocity as that of an immediately adjacent region of a respective one of said long side discharge channels.

5. An incubator or thermotherapy device comprising:

a reclining surface;

only a head side side wall as a limiting wall above said reclining surface;

discharge channels for air, said discharge channels comprising long side discharge channels provided along each of two long sides of said reclining surface, and a front side discharge channel along a front side of said reclining surface;

a guide means with guide elements set in said discharge channels at discharge angles, said guide elements being set in parallel to one another;

deflecting means with spoilers set at deflection angles with respect to said reclining surface, said spoilers comprising a long side spoiler, located along each of the two long sides of said reclining surface and a front side spoiler located along said front side of said reclining surface; and an exhaust unit located opposite the front side and positioned under said limiting wall for exhausting air, wherein:

said guide elements comprise long side guide elements, said long side guide elements being in said long side discharge channels and having discharge angles of about 90° in a vicinity of said exhaust unit and between about 15° and 90° in an area of the front side;

said long side spoilers are set at deflection angles between about 15° and 100°;

the air discharge velocity from said discharge channels is in the range of about 0.2 m/sec to 1.0 m/sec;

said guide elements comprise front side guide elements, in the front side discharge channel, said front side guide elements having discharge angles corresponding to the deflection angles of said long side spoilers; and the air discharge velocity from said front side discharge channel has a maximum of about 1.0 m/sec in a middle of said front side discharge channel and continuously changes towards the long side discharge channels and reaches the air discharge velocity of an immediately adjacent region of a respective adjacent one of said long side discharge channels.

6. An incubator or thermotherapy system comprising:

a reclining surface;

a rear limiting wall extending upwardly from said reclining surface;

a removable upper limiting wall;

a removable first long side limiting wall provided along a first long side of said reclining surface;

a removable second long side limiting wall provided along a second long side of said reclining surface;

a removable front side limiting wall provided along a front side of said reclining surface;

a first long side discharge channel for air, said first long side discharge channel being provided along said first long side of said reclining surface;

a second long side discharge channel for air, said second long side discharge channel being provided along said second long side of said reclining surface;

a front side discharge channel for air, said front side discharge channel being provided along said front side of said reclining surface;

first long side discharge channel guide elements in said first long side discharge channel at a discharge angle in relation to said reclining surface;

second long side discharge channel guide elements in said second long side discharge channel at a discharge angle in relation to said reclining surface;

front side discharge channel guide elements in said front side discharge channel at a discharge angle in relation to said reclining surface;

a first long side spoiler at a deflection angle in relation to said reclining surface;

a second long side spoiler at a deflection angle in relation to said reclining surface;

a front side spoiler at a deflection angle in relation to said reclining surface;

an exhaust unit located at said rear limiting wall opposite the front side and positioned under said upper limiting wall for exhausting air, said exhaust unit being connected to said discharge channels for supplying air thereto to set an air discharge velocity from 0.05 m/sec to 1.0 m/sec, each said discharge angle and deflection angle being set based on whether or not one or more of said limiting walls are connected or removed.

7. An incubator or thermotherapy system according to claim 6, wherein said discharge angles are 90°+/−15° for said first long side discharge channel guide elements and for said second long side discharge channel guide elements; and said deflection angles in relation to said reclining surface are 90°+/−10° for said first long side spoiler and for said second long side spoiler.

8. An incubator or thermotherapy system according to claim 6, wherein:

said removable first long side limiting wall is removed to provide said removable second long side limiting wall as a closed long side side wall opposite a long side side opening;

the discharge angle of said first long side discharge channel guide elements is set in the range of about 75° to 95°;

the deflection angle of said first long side spoiler is in the range of about 75° to 105°;

air discharge velocity from said first long side discharge channel is higher than 0.1 m/sec;

the discharge angle of said second long side discharge channel guide elements is set at 90°+/−15°;

the deflection angle of said second long side spoiler is set at 90°+/−10°;

an air discharge velocity from said second long side discharge channel is less than 0.3 m/sec;

the discharge angle of said front side discharge channel guide elements are set to correspond to the deflection angle of one of said first long side spoiler and said second long side spoiler; and the air discharge velocity from said front side discharge channel is less than 0.3 m/sec.

9. An incubator or thermotherapy system according to claim 6, wherein:

each of said removable first long side limiting wall and said second long side limiting wall is removed to provide opposing long side side openings;

the discharge angle of said first long side discharge channel guide elements and of said second long side discharge channel guide elements is set in the range of about 75° to 95°;

said deflection angle of said first long side spoiler and said deflection angle of said second long side spoiler are set between 75° and 105°;

the air discharge velocity from said first long side discharge channel and said second long side discharge channel is higher than 0.1 m/sec;

the discharge angle of said front side discharge channel guide elements is set to correspond to the deflection angle of said first long side spoiler and said second long side spoiler; and the air discharge velocity of the front side discharge channel is lower than 0.3 m/sec.

10. An incubator or thermotherapy system according to claim 6, wherein:

each of said removable first long side limiting wall and said second long side limiting wall and said front side limiting wall is removed to provide opposing long side side openings and a front side side opening;

the discharge angle of said first long side discharge channel guide elements and of said second long side discharge channel guide elements is set in the range of about 50° to 110°;

the deflection angle of said first long side spoiler and said second long side spoiler is set in the range of about 60° to 110°;

the air discharge velocity from said first long side discharge channel and said second long side discharge channel is in the range of about 0.2 m/sec to 0.5 m/sec;

said front side discharge channel guide elements are set such that said discharge angle corresponds to the deflection angle of one of said first long side spoiler and said second long side spoiler; and the air discharge velocity from said front side discharge channel has a maximum of 0.2 m/sec to 0.5 m/sec in a middle of said discharge channel and changes continuously towards said first long side discharge channel and said second long side discharge channel until the air discharge velocity from said front side discharge channel reaches the same air discharge velocity of an immediately adjacent region of a respective adjacent said first long side discharge channel and said second long side discharge channel.

11. An incubator or thermotherapy system according to claim 6, wherein:

each of said removable first long side limiting wall and said second long side limiting wall and said front side limiting wall and said upper limiting wall is removed to provide only said rear limiting wall as a head side side wall;

the discharge angle of said first long side discharge channel guide elements and said second long side discharge channel guide elements is set at a discharge angle of about 90° in a vicinity of said exhaust unit and between about 15° and 90° in an area of the front side;

the deflection angle of said first long side spoiler and said second long side spoiler is set between about 15° and 100°;

the air discharge velocity from said first long side discharge channel and said second long side discharge channel is in the range of about 0.2 m/sec to 0.8 m/sec;

the discharge angle of said front side discharge channel guide elements is set to correspond to the deflection angle of one of said first long side spoiler and said second long side spoiler; and the air discharge velocity from said front side discharge channel has a maximum of about 1.0 m/sec in a middle of said front side discharge channel and continuously changes towards said first long side discharge channel and said second long side discharge channel and reaches the air discharge velocity of an immediately adjacent region of a respective adjacent said first long side discharge channel and said second long side discharge channel.

* * * * *